United States Patent [19]

Kelley et al.

[11] 4,260,334

[45] Apr. 7, 1981

[54] GROUND DEWATERING SYSTEM

[75] Inventors: Lawrence G. Kelley, Glenview, Ill.; Wayne E. Nelson, Fenton; Clark J. Quist, Holland, both of Mich.

[73] Assignee: Kelley Contract Dewatering Company, Glenview, Ill.

[21] Appl. No.: 657,247

[22] Filed: Feb. 11, 1976

[51] Int. Cl.[3] ..... F04B 17/00

[52] U.S. Cl. ..... 417/52; 417/410

[58] Field of Search ..... 61/10-13; 417/148, 313, 53, 54, 410, 424; 166/52, 68, 68.5, 105-112; 415/121 G

[56] References Cited

U.S. PATENT DOCUMENTS

| | | | |
|---|---|---|---|
| 536,858 | 4/1895 | Donato | 417/148 |
| 1,599,744 | 9/1926 | Chapmon | 166/68 X |
| 2,210,977 | 8/1940 | Hollander | 417/424 X |
| 2,270,666 | 1/1942 | Arutunoff | 417/424 X |
| 2,622,683 | 12/1952 | Silitch et al. | 61/11 |
| 2,654,434 | 10/1953 | Culleton | 166/52 |
| 3,033,125 | 5/1962 | Pleuger | 415/121 G |
| 3,342,135 | 9/1967 | Schnabel | 417/38 |
| 3,635,591 | 1/1972 | Wilkinson | 417/424 X |
| 3,671,152 | 6/1972 | Guinard | 417/424 X |
| 3,746,473 | 7/1973 | DeLancey et al. | 417/424 X |
| 3,957,402 | 5/1976 | Sloan | 417/424 X |

*Primary Examiner*—Carlton R. Croyle
*Assistant Examiner*—Edward Look
*Attorney, Agent, or Firm*—Kinzer, Plyer, Dorn & McEachran

[57] ABSTRACT

This is concerned with a submersible pump deep well system for dewatering construction excavations in which a solid, airtight casing and attached well screen are disposed in a generally upright position in a hole in the ground adjacent an excavation or the like with a pump disposed down in the airtight casing and a water discharge line extending upwardly therefrom with the casing being sealed so that it is airtight with a vacuum created therein with the arrangement being such that the pump is at a level above the well screen so that water in the surrounding ground formation will fill in the bottom of the hole through the well screen openings and rise to a level above the bottom of the casing, thereby sealing the lower end thereof to prevent air from flowing through the surrounding formation into the casing to break the vacuum therein.

5 Claims, 1 Drawing Figure

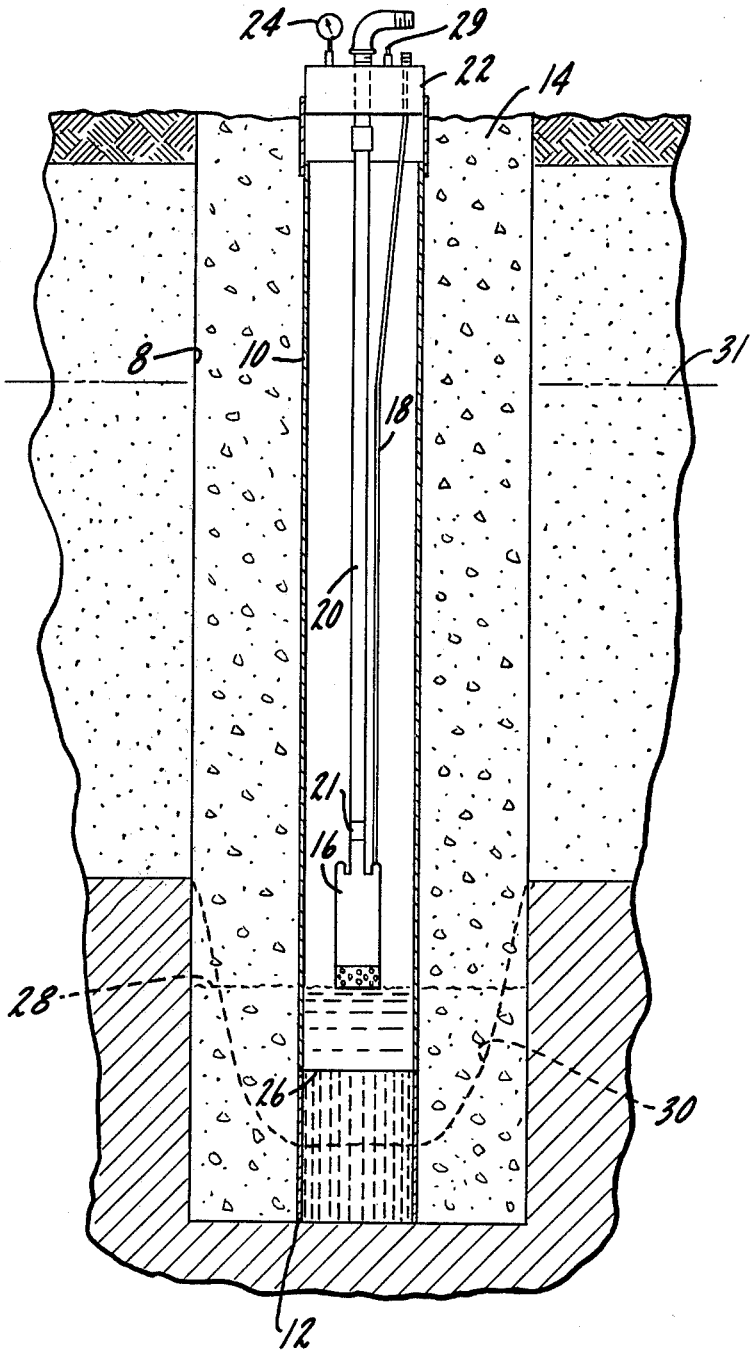
24
29
22
14
8
10
31
18
20
21
16
28
26
30
12

GROUND DEWATERING SYSTEM

SUMMARY OF THE INVENTION

This invention is concerned with a dewatering system of the so-called submersible pump deep well type for the ground around a construction excavation or the like.

A primary object of the invention is a ground dewatering system of the so-called submersible pump deep well type which greatly increases the discharge flow rate from water bearing pervious soil formation for a given size pump.

Another object is such a system which greatly increases the discharge flow rate without adding to the expense.

Another object is a system for increasing the discharge flow rate from such a system by a simple relocation of certain standard parts or components.

Another object is such a system which reduces the number of wells required.

Other objects will appear from time to time in the ensuing specification and drawings.

BRIEF DESCRIPTION OF THE DRAWINGS

The single FIGURE is a sectional view of the invention.

DESCRIPTION OF THE PREFERRED EMBODIMENTS

In the drawing a cross section through a conventional shaft is diagrammatically shown. Where it is desired to remove the subterranean water or underground lake around an area where an excavation either is to start or is already started, it is conventional to drill a series of shafts in the ground around the excavation area. These shafts may be something on the order of 12 to 48 inches in diameter and may go down to whatever depth is desired for the excavation. In the drawing the shaft or well outer casing is indicated generally at 8 and a conventional solid, airtight, impervious casing 10 is then disposed down the shaft generally in the center thereof with a cylindrical screen 12 at the bottom which may be of any suitable length extending below the lower end of the casing, for example something on the order of 4 to 8 feet. The casing and screen may be about a foot more or less in diameter. The area or volume around the casing and screen may then be filled with well filter material, for example, as indicated generally at 14, which may extend from the bottom to the top or surface of the hole.

A submersible pump 16 is then lowered down the center of the casing with a suitable power cord 18 and a water upflow or discharge pipe 20 extending upwardly therefrom to the surface in a conventional manner. The discharge pipe may have a nonreturn or check valve 21. The top of the casing is closed and sealed by a suitable head element and coupling, as diagrammatically indicated at 22, so that a vacuum may be created and maintained inside of the airtight casing. A suitable vacuum gauge 24 may be connected to the sealed top, if desired.

In the arrangement shown it will be noted that the submersible pump 16 is positioned at a level slightly above the bottom 26 of the casing, which is to say slightly above the top of the screen. The distance that the pump is above the level of the bottom of the casing 26 is somewhat arbitrary and in the arrangement shown, the proportioning would indicate that it is about 8" above. But this is by no means critical. The result is that the water in the surrounding soil will collect in the bottom of the hole, will flow inwardly through the screen 12 up to a certain level indicated at 28, which is the general level of the bottom of the pump. This water level will be both inside and outside of the casing, as indicated by the broken line in the drawing. Since the water in the bottom of the hole up to level 28 in effect seals the bottom end of the impervious casing 10, air in the surrounding soil cannot flow through the screen 12 to break or reduce the vacuum inside the casing 10. The result is that a quite high vacuum can be maintained inside of casing 10.

The use, operation and function of the invention are as follows:

In prior submersible pump deep well systems similar to the one shown in the drawing hereof, it has been conventional to position the pump at the bottom of the hole, say, inside of the perforate screen 12 and possibly on the bottom. With the pump located at the bottom of the screen, as water is lowered in the casing below its bottom into the screen, the outside original water table begins to lower by means of gravity flow into the well from the surrounding formation, particularly if it is fine silty sand or coarse sand, or the like. The outside original water table may be, for example, at 31 in the drawing. Outside atmospheric air is above this original water table and as the water flows inwardly into the hole and through the screen 12, the air will enter into it in sufficient volume such that it has been very difficult, if not impossible, to maintain a high vacuum inside of casing 10, which is to say that the pressure differential which can be created and maintained inside of or across the casing 10 is relatively low because the air in the surrounding formation flows inwardly into the well filter material area 14, through the screen 12, and up inside of the casing. With the pump positioned, say, in the bottom of the hole inside of screen 12, the level of the accumulated water in the bottom of the hole will be, say, toward the bottom of the hole, for example generally along broken line 30 in the drawing. It will be noted that only the bottom portion of the screen is submerged in the water collected in the bottom of the hole and the top portion of screen 12 is open. This means that the air in the surrounding formation can flow through the top portion of the screen and will prevent a high vacuum from either being created or maintained in the casing 10.

It is important that a high vacuum exist inside of casing 10 since it is the pressure differential between the air in the surrounding formation on the one hand and the vacuum inside of casing 10 on the other that is forcing the water in the surrounding formation into the hole. Gravity, of course, is also exercising an influence, but the air pressure differential is the main contributing force and is a much greater force than gravity alone.

With the pump positioned as shown in the drawing so that the level thereof is above the bottom end 26 of the casing, the water that collects in the bottom of the hole up to the general level 28 will form a seal or lock across the lower end of the impervious casing 10, thereby preventing air above the outside original water table from entering the screen, as the water never goes below the bottom of the casing to allow air to enter the screen. The result is that a quite high vacuum can be maintained inside of casing 10 and the atmospheric air pressure pushing down all around the hole, through the sandy soil and the gravel around the outside of the casing, will cause all or a substantial part of the entrained water in the area around the hole to flow much more rapidly into the bottom of the hole. In prior installations where the pump 16 has been positioned in the bottom of the hole inside of screen 12, the discharge rate of water by the pump up through tube 20 has been, for example, 15 gallons per minute, whereas in the same or a similar installation where the pump has been raised up above the lower end of the casing 10, such as shown in the drawing, the discharge rate was raised to something on the order of 65 gallons per minute, everything else being generally equal.

In addition, the pump tends to create its own vacuum which is to say that if the original water level 31 tends to be lowered in the casing to the bottom of the pump because the pump is discharging water faster than it can flow into the bottom of the hole, the pump will begin to discharge a combination of water and air that exists inside of the casing. But this will create a vacuum inside the casing or a pressure differential between the outside and the inside which will tend to speed up the flow of water from the surrounding formation into the bottom of the hole. The result is that a separate vacuum connection and outside vacuum pump may not be necessary, although it may be used in certain installations, if desired, as indicated at 29. The check valve 21 in the discharge line will prevent the water from flowing back down and through the pump, in the event of a power failure, for example, which would allow air to come down the discharge pipe and break or reduce the vacuum. Also, a pressure relief valve, not shown, may be provided in the head element or top to relieve any excessive buildup of positive air pressure in the casing in the event, for example, that water would rise inside of the casing and change the vacuum to a positive pressure.

Some of the advantages of the present invention are that it does not require any special or unusual components or novel individual items. Rather, the casing, the screen at the bottom, the pump, the tubing, the power lines, etc. are or may be all old and well known. So no "specials" are necessary, although they may be used, if desired. But rather, conventional well known components that have long existed in the industry may be used to practice the invention.

While the preferred form of the invention has been shown and described, it should be understood that suitable modifications, changes, substitutions and alterations may be made without departing from its fundamental theme.

The embodiments of the invention in which an exclusive property or privilege is claimed are defined as follows:

1. In a dewatering system, a solid airtight casing generally vertically disposed in the ground with the upper end thereof being sealed and disposed generally at the surface, a screen across the lower end of the casing, a pump inside the casing at a level above the screen so that water will rise above the screen inside the casing to seal the lower end of the casing to prevent air in the surrounding soil from flowing through the screen and into the lower end of the casing, and a water discharge line from the pump up through the casing to discharge water at the surface.

2. The structure of claim 1 further characterized in that the pump is constructed and arranged to help create a vacuum in the casing above the water level.

3. The structure of claim 1 further characterized in that the casing is disposed in an oversized hole in the ground which is filled with well filter material around the casing.

4. The structure of claim 1 further characterized in that the screen is in the form of a perforate cylinder attached to the lower end of the casing and extending downwardly therefrom.

5. A method of dewatering the ground around and adjacent to an excavation in which an impervious sealed casing is disposed in a generally upright position in a hole in the ground with a screen across the lower end and a pump positioned in the casing adjacent the bottom with a discharge line extending upwardly therefrom to discharge water that collects in the hole, including the step of positioning the pump at a level no lower than the bottom end of the casing so that water will rise in the hole to a level to seal off the lower end of the casing, thereby preventing air in the surrounding ground formation from flowing inwardly through the screen into the lower end of the casing and breaking the vacuum created therein.

* * * * *